US006659459B2

(12) United States Patent
Dewa et al.

(10) Patent No.: US 6,659,459 B2
(45) Date of Patent: Dec. 9, 2003

(54) DIE CAPABLE OF BEING OPENED, MANUFACTURING METHOD THEREOF, AND MOLD

(75) Inventors: Shoji Dewa, Tokyo (JP); Akihiro Takatoku, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 09/785,325

(22) Filed: Feb. 20, 2001

(65) Prior Publication Data

US 2001/0015526 A1 Aug. 23, 2001

(30) Foreign Application Priority Data

Feb. 18, 2000 (JP) ..... 2000-040936

(51) Int. Cl.[7] ..... A63F 9/04
(52) U.S. Cl. ..... 273/146; 273/148 R
(58) Field of Search ..... 273/146, 138.1, 273/148 R; D21/372, 373

(56) References Cited

U.S. PATENT DOCUMENTS 1,292,188 A * 1/1919 Wheeler
3,359,657 A * 12/1967 Hedberg
3,450,408 A * 6/1969 Hagerman
3,547,444 A * 12/1970 William
3,774,339 A * 11/1973 Swett
3,940,142 A * 2/1976 Hinz
4,489,946 A * 12/1984 Burges

FOREIGN PATENT DOCUMENTS

| | | |
|---|---|---|
| CN | 2061853 U | 9/1990 |
| CN | 2085676 U | 10/1991 |
| DE | 8705084 U | 4/1988 |
| GB | 2202159 A | 9/1988 |
| JP | 7-112734 | 5/1995 |
| JP | 8-143034 | 6/1996 |

OTHER PUBLICATIONS

JP Comic Strip Publication, pp. 95 and 96 –The structure of the dice is shown in the comic and is self–explanatory.

* cited by examiner

*Primary Examiner*—Benjamin H. Layno
*Assistant Examiner*—Vishu K Mendiratta
(74) *Attorney, Agent, or Firm*—Sughrue Mion, PLLC

(57) ABSTRACT

In a die which has a regular polyhedron form and which can be opened into a continuous polygonal form on a plane, boundary areas (Rb) between planes (11 through 16) on the inner side of the regular polyhedron have inclination angles determined according to the regular polyhedron. In addition, engaging portions (21*a*, 21*b*, 24*a*, 24*b*, 25*a*, 25*b*, 26*a*, 26*b*) not exceeding the respective boundary areas (Rb) are placed on the boundary areas (Rb) of predetermined planes (11 through 16). Such a die is formed by injecting plastic resin within a mold (31, 32) according to the form of the opened die. This realizes a three-dimensional die capable of being opened onto a two-dimensional plane, which has only been fictionally conceived, and further provides a manufacturing method thereof.

9 Claims, 8 Drawing Sheets

FIG. 2A
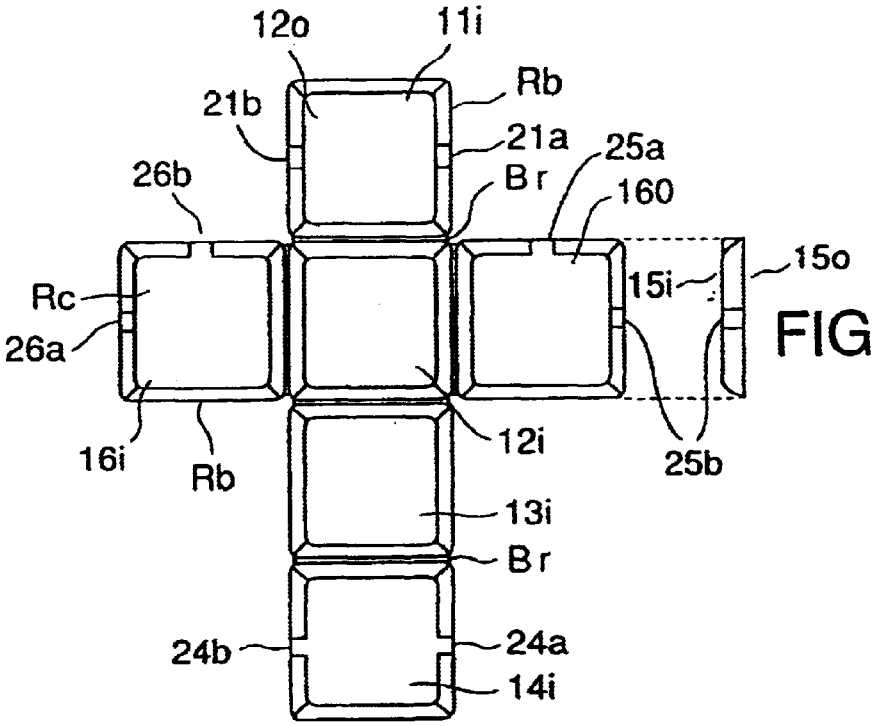
FIG. 2B
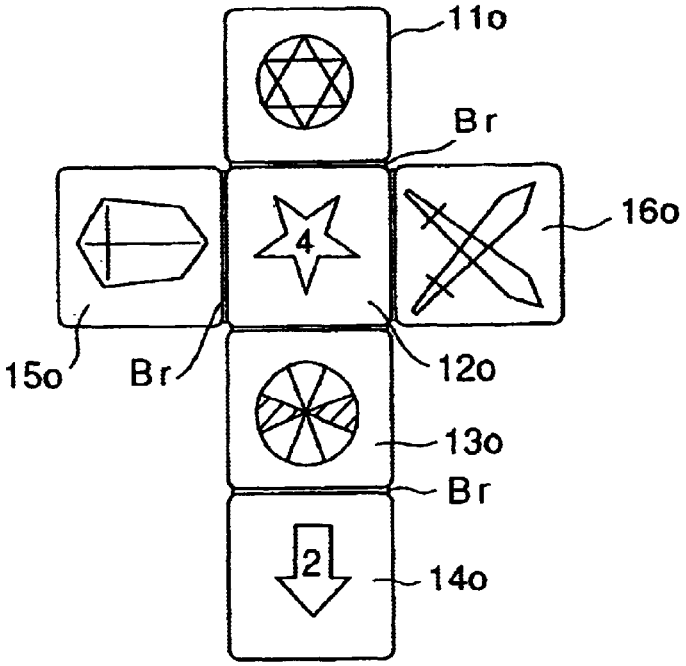
FIG. 2C

FIG. 8A
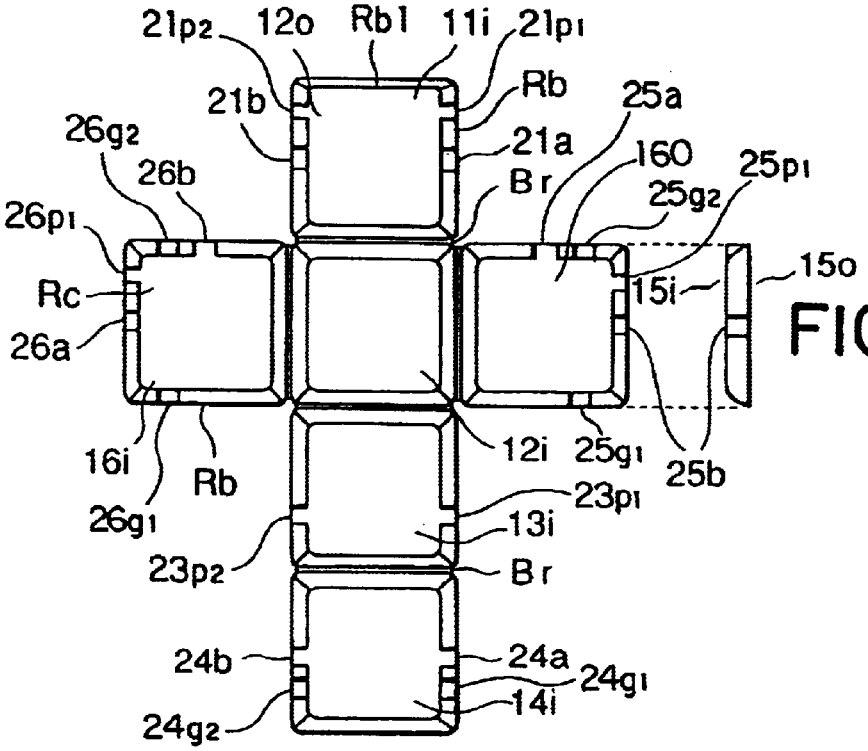
FIG. 8B
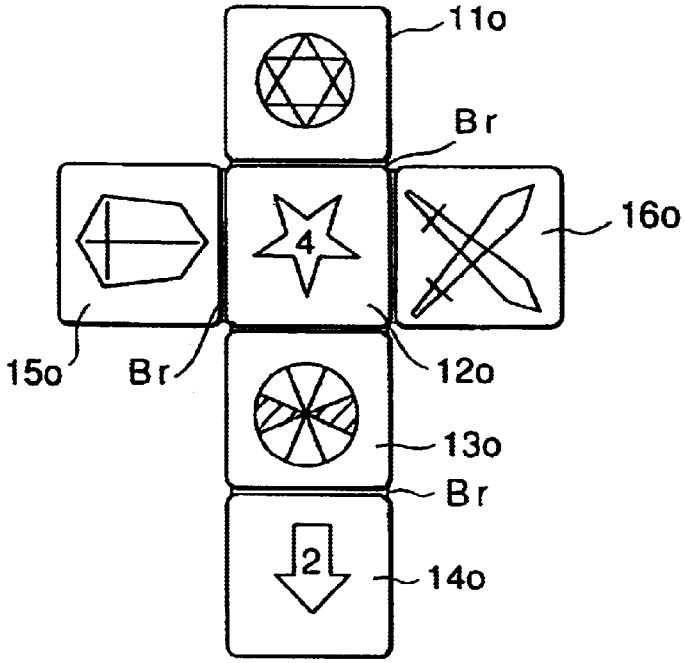
FIG. 8C

DIE CAPABLE OF BEING OPENED, MANUFACTURING METHOD THEREOF, AND MOLD

BACKGROUND OF THE INVENTION

The present invention relates to a die (dice) used with board games, and the manufacturing method thereof, and further relates to a mold used for manufacturing the die.

Various types of board games have long been enjoyed, such as shogi, go, dominoes, Othello, and so forth. Among such board games, there are many games wherein dice are cast, and the results the dice roll are reflected in the subsequent game, such as Parcheesi. In such board game using dice, the rolling results of the dice greatly affects winning or losing the game.

On the other hand, recently, there are comic books portraying a fictional entertainment world, which describe a fictional board game called Dragon Dice & Dungeons (hereafter abbreviated to "DDD"). In the DDD, characters battle with each other in the comics. The DDD is at first specified by using multiple dice having markings different from those of standard dice. Each die is effective to cause effects and rolling results of the dice. In addition, the DDD is also specified by opening each of the dice in a two-dimensional manner on the board. In the case of this DDD, opening the dice two-dimensionally determines routes and encampments according to the two-dimensional polygonal form of the opened dice. That is to say, with DDD, not only the rolling results of the dice are used in the game, but also the dice are also used for determining routes and encampments by the opened dice. Further, with a fictional world described by the comic, monsters appear from the opened die on the board according to individual dice and battle with the other monster or monsters virtually.

However, there are many problems in realizing such a fictional board game described in the comics as an actual board game. For example, in the event that the above-described DDD is to be played by actual players, dice which can be two-dimensionally opened, i.e., opened and closed, by the players, are necessary, but conventionally there has never been a proposal made of dice capable of being opened out or opened and closed, and what configuration would allow this to be realized cannot be guessed from the comics. Also, the material of a die capable of being opened, the die configuration necessary for opening, and so forth, cannot be guessed. Further, there are problems, such as placing monsters or the like within dice capable of being opened would make the dice too large, and further, the monsters in the dice would throw the center of gravity of the dice off-center and change the probability of what the cast dice show, so this is not realistic.

SUMMARY OF THE INVENTION

Accordingly, it is an object of the present invention to realize a fictional board game using dice which can be opened such as with DDD, as an actual board game.

It is another object of the present invention to realize a die which can be opened two-dimensionally by a player in a polygonal form.

It is a further object of the present invention to provide a manufacturing method for a die which can be opened two-dimensionally, and a mold used for the manufacturing thereof.

According to one aspect of this invention, there is provided a die which is structured by a polyhedron having multiple planes (11 through 16) of a similar shape and which is opened into a continuous polygonal area on a plane, wherein, in the assembled state of the polyhedron, the die has outer planes (11*o* through 16*o*) positioned on the outer side and inner planes (11*i* through 16*i*) positioned on the inner side, and has boundary areas (Rb) having a predetermined inclination angle at boundaries of the polygonal area of the inner side, while boundary areas (Rb) of predetermined planes of the opened polygonal area have engaging portions (21*a*, 21*b*, 24*a*, 24*b*, 25*a*, 25*b*, 26*a*, 26*b*) of a size not exceeding each boundary area (Rb).

According to another aspect of this invention, there is provided a method for manufacturing a die which is configured of a polyhedron having multiple planes (11 through 16) of a similar shape and which can be opened into a continuous polygonal area on a plane, wherein a mold (31, 32) is prepared, the mold (31, 32) having the form of the opened polyhedron and comprising a portion equivalent to the opened polyhedron having a predetermined spacing in the thickness direction, and portions equivalent to boundaries (Rb) of the polyhedron having spacing narrower than the predetermined spacing, and wherein forming is performed by injecting a predetermined resin into the mold (31, 32), thereby obtaining the die.

According to yet another aspect of this invention, there is provided a mold (31, 32) for manufacturing a die which is configured of a polyhedron having multiple planes (11 through 16) each with mutually equal forms and which can be opened into a continuous polygonal area on a plane, the mold having the form of the opened polyhedron and comprising a portion equivalent to the opened polyhedron having a predetermined spacing in the thickness direction, and portions equivalent to boundaries (Rb) of the polyhedron having spacing narrower than the predetermined spacing.

According to yet another aspect of this invention, there is provided a die which can be opened in a polygonal configuration on a flat surface, which can be assembled three-dimensionally, and which is structured by a plurality of planes. When the die is three-dimensionally assembled, a gap is left between two of the planes, at least predetermined one of which is smaller in size than the remaining planes.

BRIEF DESCRIPTION OF THE DRAWING

FIGS. 2A, 2B, and 2C are inner surface, edge, and outer surface drawings for describing the die shown in FIG. 1 opened;

FIGS. 8A, 8B, and 8C are inner surface, edge, and outer surface drawings for describing the die shown in FIG. 1 opened;

DESCRIPTION OF PREFERRED EMBODIMENTS

Figure 1:
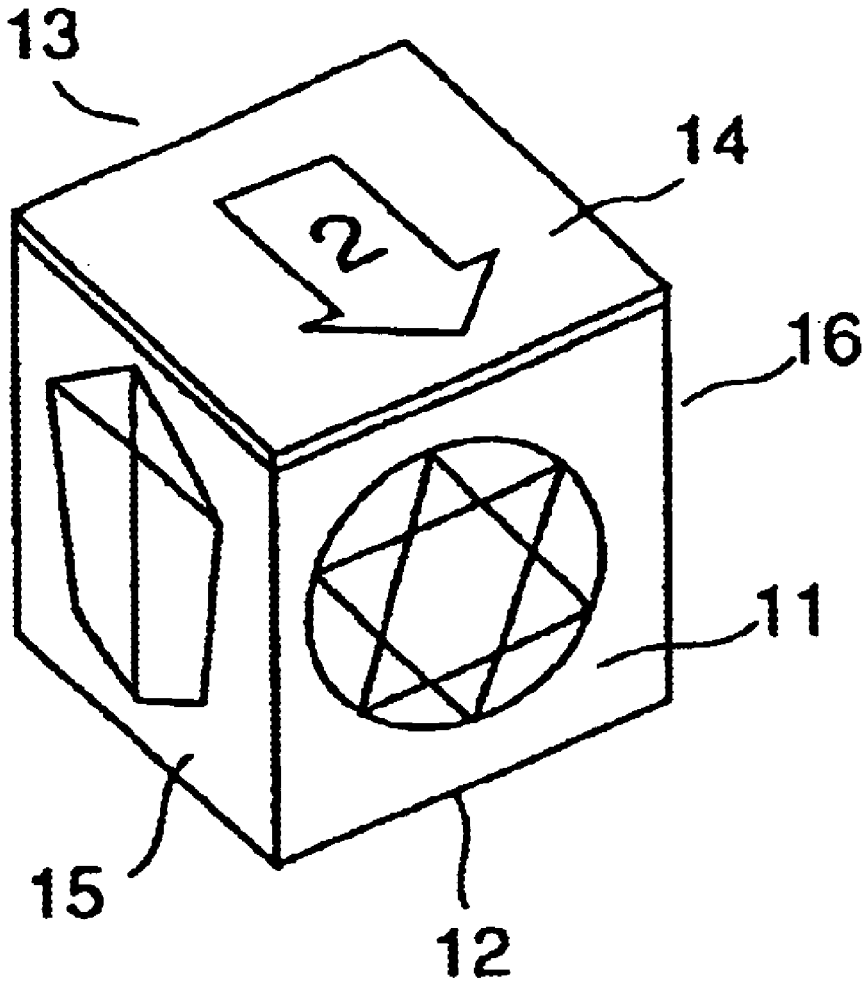
FIG. 1 is a perspective view for describing a die according to one embodiment of the present invention.

FIG. 1 shows a perspective view illustrating the external view of a die relating to the present invention, comprising a cube, and markings different to those of standard dice are displayed on each of the six square planes making up the outer surface thereof. These marks each have crucial meanings in the game, but are irrelevant to the present invention, so description thereof will be omitted here.

The die shown in FIG. 1 can be opened onto a two-dimensional polygonal plane as shown in FIGS. 2A through 2C, by pulling the plane upwards in an upward direction. Specifically, the die shown in FIG. 1 is configured by linking six square planes (hereafter called first through sixth planes), and also providing engaging portions at boundaries positioned at the perimeter of certain planes. Further, the die shown in the figure is formed by injecting polypropylene resin in a mold and forming. In this example, polypropylene resin has been used, but other resin may be used instead. Here, an actual die has heightwise and widthwise dimensions of 22.88 mm each, and further is formed of first through sixth planes 11 through 16 each having thickness of 3 mm.

FIG. 2A illustrates the inner surface which appears when the die according to a first embodiment of the present invention is opened two-dimensionally. The illustrated inner surface is positioned inside the die in the event that the die is assembled as shown in FIG. 1, and thus not visible from the outside. FIG. 2B is a diagram illustrating a side of one of the planes of the opened die, and FIG. 2C is a diagram illustrating the outer surface which is positioned outside the die in the event that the die is assembled, with the markings shown in FIG. 1 displayed on each plane. Now, FIGS. 2A through 2C only illustrate one example of polygonal forms which can be opened from the die shown in FIG. 1, and it should be noted that the present invention may be configured so as to be opened into other polygonal forms.

The die according to the present invention will be described in further detail, with reference to FIGS. 2A through 2C. As shown in FIG. 2A, the inner surface of the die is configured of first through sixth square inner planes 11*i* through 16*i*, corresponding to the first through sixth planes 11 through 16. In the example shown in the figure, the first through fourth inner planes 11*i* through 14*i* are linearly linked, and the second, fifth, and sixth inner planes 12*i*, 15*i*, and 16*i*, are also linearly linked. It can thus be clearly understood that the die according to the present invention can be opened into an area with a polygonal form of six continuous planes, without the planes being separated one from another. It is also clear from the figure that the inner planes 11*i* through 16*i* have a center area Rc which is of a flat and square form, and a boundary area Rb which surrounds the perimeter thereof.

In this example, the boundary or border areas Rb of the inner planes 11*i* through 16*i* each have a width of 2 mm, and have an inclination angle of around 45 degrees. On the other hand, the center areas of the inner planes 11*i* through 16*i* each have an area of 18 mm×18 mm, and have a thickness of 3 mm. Certain symbols are either printed on these center areas, or printed stickers are applied thereto.

Figure 3:
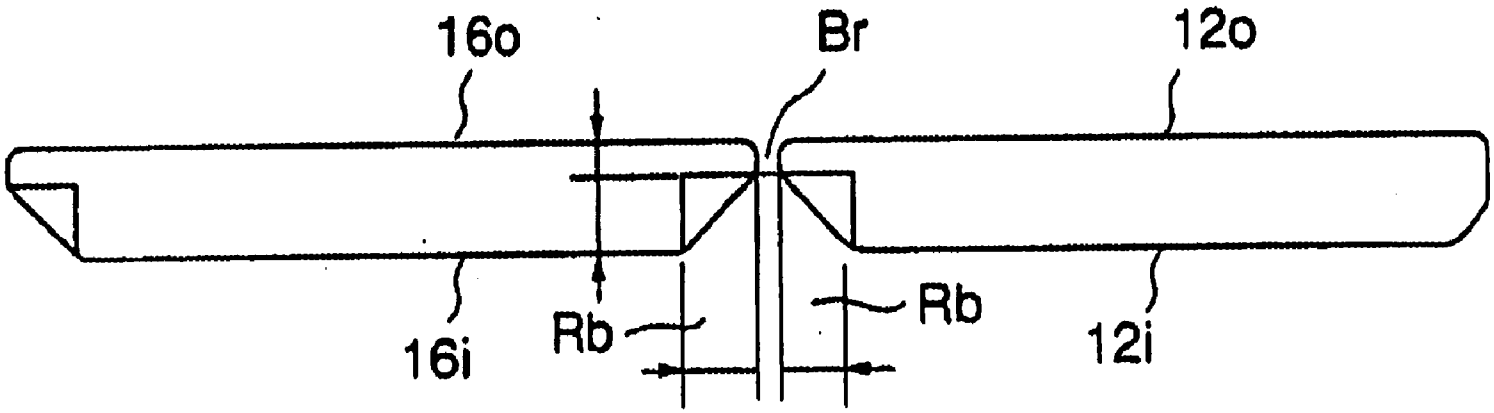
FIG. 3 is a partial cross-sectional view for describing the die shown in FIGS. 2A through 2C opened, in greater detail.

Now, with the continuously-formed sixth and second planes 16 and 12 as an example, the boundary area Rb and bridge portion Br between the mutually adjacent planes will be described, with reference to FIG. 3. As shown in the figure, boundary areas Rb having inclination angle portions of around 45 degrees are formed to the inner sixth and second inner side 16*i* and 12*i* sides of the sixth and second planes 16 and 12, and the inclined portions are provided over a distance of 2 mm in the direction of the thickness. The planes 16 and 12 are linked by an extremely thin thin-film-like bridge portion Br provided at the edge portion of the inclined portions. Here, the bridge portion Br shown in the figure has a width of 0.6 mm, and a thickness of around 0.2 mm. Thus, the bridge portion Br liking adjacent planes is extremely thin in comparison with the adjacent planes, so a linearly extending groove is formed between the outer planes 160 and 120 of either plane, as shown in FIG. 3.

Accordingly, the planes 16 and 12 can be bent inwards bordering on this groove portion. Also, the inclination angle of adjacent boundary areas Rb is around 45 degrees, so in the event that the adjacent planes 16 and 12 are bent inwards, bending of 90 degrees or more can be prevented.

Description will be made regarding the structure of the engaging portion for maintaining the form of the die when the die shown in FIG. 1 is assembled, with reference to FIGS. 2A and 2B. At the boundary area Rb of the first inner plane 11*i* shown in FIG. 2A, a pair of recesses 21*a* and 21*b* are formed at the portion linking the sixth and second inner planes 16*i* and 12*i* within a range not crossing the boundary area Rb.

On the other hand, a protrusion 26*b* which engages the recess 21*b* formed to the boundary area Rb of the first inner plane 11*i* is provided to the boundary area Rb of the sixth inner plane 16*i* which is linked to the first inner plane 11*i*, and also, a protrusion 25*a* which engages the recess 21*b* formed to the boundary area Rb of the first inner plane 11*i* is provided to the boundary area Rb of the fifth inner plane 15*i*.

Also, it is preferable that the protrusions provided on the boundary area Rb are formed so as to not protrude out upwards from the inner plane. This is because with the above-described DDD, the die opened on a flat plane is used as an encampment, and in the event that there is something protruding out upwards from the inner plane, the characters placed on the inner plane may become unstable, or the characters may hang thereon at the time of moving the characters and cause the position of the die to move, and this is to prevent such.

In the example shown in FIGS. 2A through 2C, at the time of assembling the die, protrusions 24*a* and 24*b* are formed at the boundary area Rb provided on the fourth inner plane 14*i* coming into contact with the fifth and sixth inner planes 15*i* and 16*i*, and recesses 25*b* and 26*a* are formed at the boundary areas Rb provided on the fifth and sixth inner planes 15*i* and 16*i* so as to correspond to the protrusions 24*a* and 24*b* of the fourth inner plane 14*i*.

As shown in the figure, of the six planes making up the cube-shaped dice, engaging portions formed of recesses and protrusions are provided with the boundary areas Rb of four planes, thereby configuring a die capable of speedy assembly, and also capable of easily being opened onto a two-dimensional plane. Consideration may be made about the structure which has the engaging portions on the boundary areas Rb of the five inner planes.

With reference to FIG. 2C, the outer planes 110 and 160 of the first through sixth planes are mutually linked by the bridge portions Br, and the planes can be bent to the rear side in FIG. 2C on the bridge portions Br. Accordingly, the bridge portions Br might be called bending portions.

With FIG. 2A, only an arrangement wherein engaging portions are formed by combining recesses and protrusions that are provided only one apiece to each edge of each inner plane has been described so far, but a die can be assembled in the same manner as FIG. 2A by positioning multiple protrusions with spacing therebetween on one edge which is to be joined, and providing protrusions upon the other edge so as to be held between the multiple protrusions. In this case as well, making the protrusions on either edge to be of a size so as to not protrude out from the boundary areas Rb of the respective inner planes, is necessary in configuring a die which has a flat and polygonal form without protrusion in the event of being opened and also free of gaps when assembled.

Figure 4:
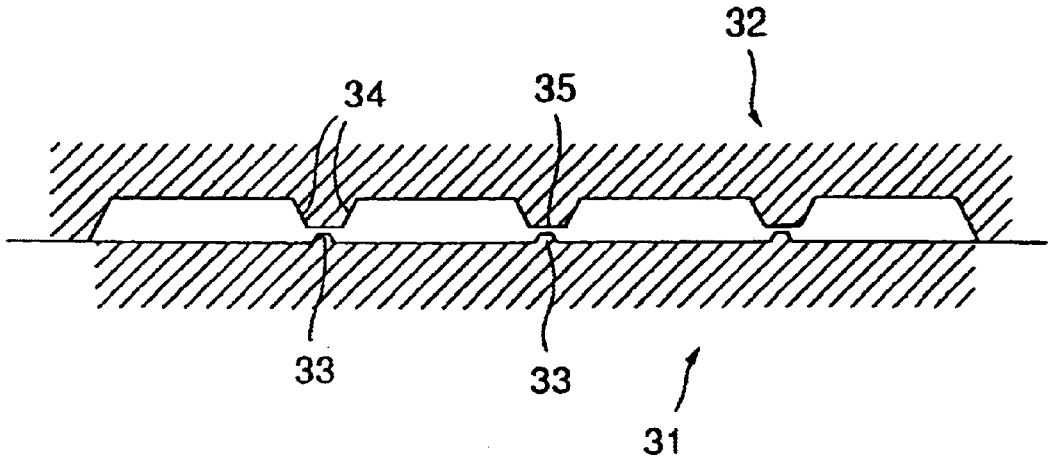
FIG. 4 is a diagram for describing the mold used for manufacturing the die according to the present invention.

Next, the method of manufacturing the die relating to the present invention will be described using the schematic configuration diagram of a mold shown in FIG. 4. As shown in FIG. 4, the mold used with the present invention is configured of a lower mold 31 and an upper mold 32. The lower mold 31 has raised portions 33 corresponding to the bridge portions Br. On the other hand, the upper mold 32 has inclined portions 34 at the portions corresponding to the boundary areas Rb of the respective inner planes, and gate portions 35 connected to the inclined portions 34. As can be understood from the figure, the gate portions 35 of the upper mold 32 face the raised portions 33 of the lower mold 32, thus configured so as to enable forming of the bridge portions Br between the planes. Note that the size of the mold is generally the same as that of the die described with reference to FIGS. 2A through 2C, and the engaging portions are also generally the same, so description thereof will be omitted here.

As shown in the figures, the opened die is such that the thickness of the bridge portions Br is extremely thin as compared to the first through sixth planes 11 through 16. Accordingly, in the event that resin such as propylene or the like is injected from one place, the first through sixth planes and bridge portions Br might not be formed at a uniform thickness. With the mold according to the present invention, this is taken into consideration, and resin is injected into the mold from multiple inclined portions near the bridge portions Br, thereby sufficiently filling the gate portions for forming the extremely thin bridge portions Br with resin, as well. Incidentally, as for the method of injecting resin and forming the die, either injection molding or extrusion molding may be used.

After the mold shown in the figure is filled with resin and a predetermined amount of time elapses, opening the mold yields the die formed in the shape shown in FIGS. 2A through 2C.

Figure 5:
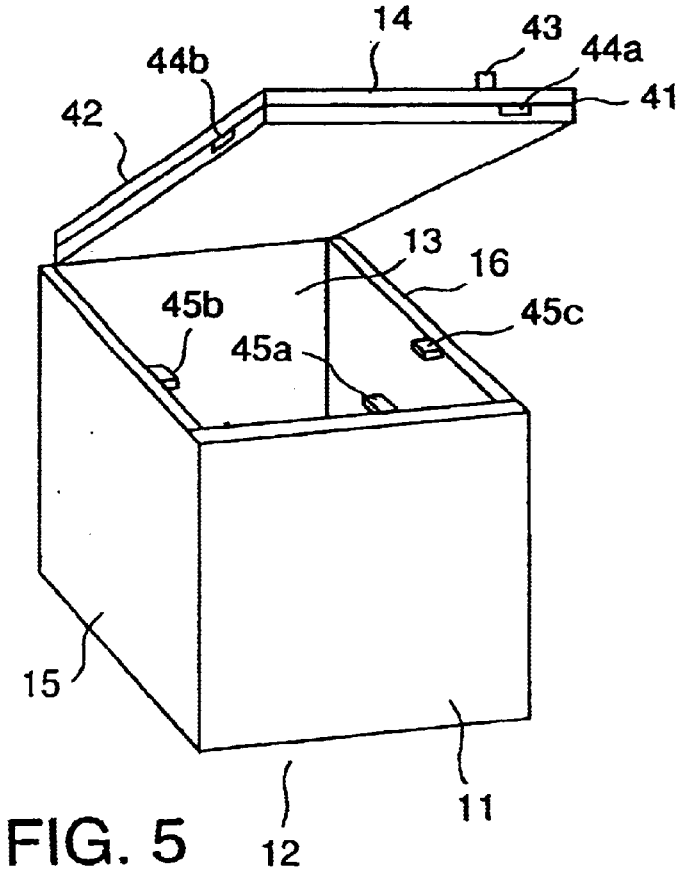
FIG. 5 is a schematic configuration diagram for describing a die according to another embodiment of the present invention.
Figure 6A:
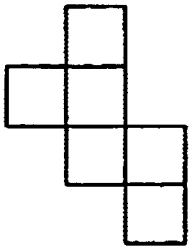
FIGS. 6A through 6F are drawings for describing the die opened in two-dimensional forms different to the example shown in FIGS. 2A through 2C.
Figure 6B:
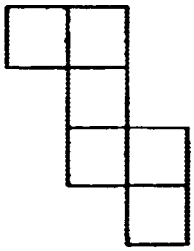
Figure 6C:
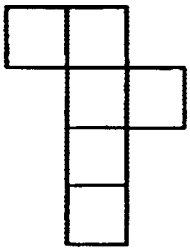
Figure 6D:
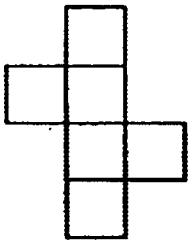
Figure 6E:
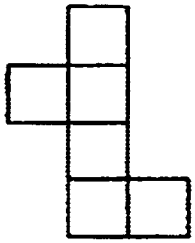
Figure 6F:
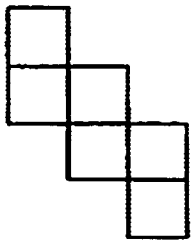

A die according to another embodiment of the present invention will be described with reference to FIG. 5. In FIG. 5 as well, the same reference numerals denote the planes corresponding to FIG. 1 and FIGS. 2A through 2C, and the die shown in FIG. 5 is arranged to be opened into a two-dimensional form the same as with that in FIGS. 2A through 2C. The die shown in the figure has a configuration whereby it can be opened into a two-dimensional form with a single touch. Accordingly, the die shown in the figure has a fourth plane 14 configured of first and second walls 41 and 42. Of these, a button is provided upon the first wall 41 positioned within the die so as to pass through the second wall 42 and protrude therefrom, so that pressing the button 43 enables the first wall 41 to be pressed downwards.

Also, of the edges of the first wall 41, the portions facing the first plane 11, fifth plane 15, and sixth plane 16 are each provided with recesses 44*a*, 44*b*, and 44*c* (44*c* not shown) respectively. On the other hand, the first plane 11, fifth plane 15, and sixth plane 16 are each provided with protrusions 45*a*, 45*b*, and 45*c*, respectively facing the recesses 44*a*, 44*b*, and 44*c*. Also, the links between the fourth plane 14 and the third plane 13, between the fifth plane 15 and the second plane 12, between the second plane 12 and the third plane 13, and between the first plane 11 and the sixth plane 16, are of a hinged structure so as to open outwards as shown in the figure, centered on the axes thereof.

In the event that the configuration shown in the figure is used, in the state that the die is assembled the protrusions 45*a*, 45*b*, and 45*c*, of the first plane 11, fifth plane 15, and sixth plane 16 respectively are in a state of being engaged with the recesses 44*a*, 44*b*, and 44*c* of the fourth plane 14.

In this state, in the event that the button 43 on the fourth plane 14 is pressed downwards in the drawing, the engaged state of the recesses 44*a*, 44*b*, and 44*c* and the protrusions 45*a*, 45*b*, and 45*c* is disengaged, such that the first plane 11, fifth plane 15, and sixth plane 16 respectively fall over in the near, left, and right directions in the figure, thus being opened into a two-dimensional form the same as that shown in FIGS. 2A through 2C. That is to say, the button 43 provided upon the fourth plane 14, the recesses 45*a*, 44*b*, and 44*c*, and the protrusions 45*a*, 45*b*, and 45*c* make up an opening mechanism whereby opening can be performed with a single touch, simply by pressing the button 43.

Accordingly, this configuration is advantageous in that simply pressing the button 43 opens the cubic dice onto a two-dimensional plane.

The above description has been made only regarding cases wherein the die is to be opened into the two-dimensional form shown in FIGS. 2A through 2C, but the present invention is not restricted to the two-dimensional form shown in FIGS. 2A through 2C; rather, the configuration may be such that is opened into forms shown in FIGS. 6A through 6F, for example. A cubic die can be assembled from any of the polygonal shaped patterns shown in FIGS. 6A through 6F, in the same manner as that shown in FIGS. 2A through 2C.

Figure 7:
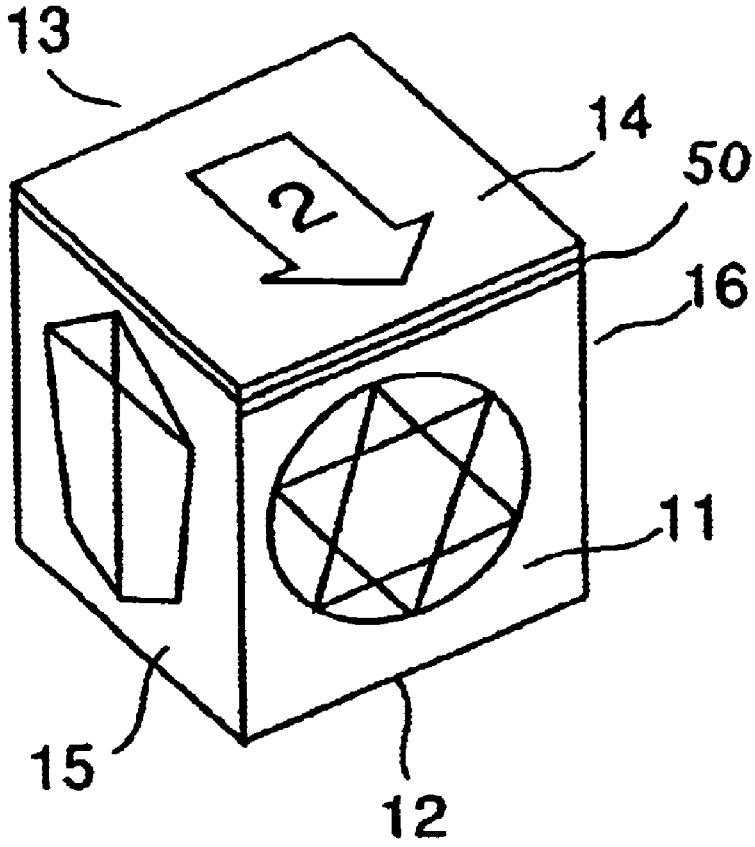
FIG. 7 is a perspective view for describing a die according to another embodiment of the present invention.

Referring to FIGS. 7 and 8A to 8C, description will be made about another embodiment of the present invention. The die illustrated in FIG. 7 is different from that illustrated in FIG. 1 in that a clearance or a gap 50 is left between the fourth plane 14 and the first plane 11. The die shown in FIG. 7 is effective to be easily opened or flattened by inserting a fingertip or a fingernail into the gap 50.

FIGS. 8A, 8B, and 8C show an opened state of the die illustrated in FIG. 7. It is readily understood with reference to FIGS. 7 and 8A to 8C that the first inner plane 11*i* and the fourth inner plane 14*i* are adjacent to each other. when the die is assembled from the opened state illustrated in FIG. 7 and that the gap 50 is left between the first and the fourth planes 11 and 14 in this embodiment, as mentioned in conjunction with FIG. 7. In other words, the first plane 11 adjoins the fourth plane 14 with the gap 50 interposed therebetween, when the die is three-dimensionally assembled, as shown in FIG. 7.

In order to leave the gap 50 between the first and the fourth planes 11 and 14, it is to be noted that the first inner plane 11*i* has a narrow boundary area Rb1 which is narrow in width as compared with the remaining boundary areas Rb. Stated otherwise, the width of the boundary area Rb1 of the first inner plane 11*i* is narrower on the inclination angle portion than that of each of the remaining boundary areas Rb of the second through the sixth inner planes 12*i* to 16*i*.

The illustrated narrow boundary area Rb1 is positioned adjacent to the fourth inner plane 14*i*, on assembling the die. This means that the first inner plane 11*i* does not have an accurate square configuration and is different in configuration from the other inner planes 12*i*, 13*i*, 14*i*, 15*i*, and 16*i*. As a result, the first inner plane 11*i* is somewhat smaller in size than the remaining five inner planes 12*i* to 16*i*. In fact, the width of the boundary area Rb1 of the first inner plane 11*i* is narrower than a half of each width of the remaining boundary areas Rb and may be smaller than 1 mm, for example.

Moreover, the die illustrated in FIGS. 8A to 8C has protrusions and recesses greater in number than those illustrated in FIG. 2, so as to strongly keep a fastened or engaged state. In the illustrated example, two of the protrusions 23*p*1 and 23*p*2 are located on the boundary areas Rb of the third inner plane 13*i* while the recesses 25*gi* and 26*g*1 engaged with the protrusions 23*p*1 and 23*p*2 are located on the boundary areas of the fifth and the sixth inner planes 15*i* and 16*i*, respectively. Likewise, two recesses 24*g*1 and 24*g*2 are formed on the boundary areas of the fourth inner plane 14*i*. The corresponding protrusions 25*p*1 and 26*p*1 that are engaged with the recesses 24*g*1 and 24*g*2 are placed on the boundary areas Rb of the fifth and the sixth inner planes 15*i* and 16*i*, respectively. In addition, two of the protrusions 21*p*1 and 21*p*2 are added to the boundary area of the first inner plane 11*i* and the corresponding recesses 25*g*2 and 26*g*2 are placed on the boundary areas Rb of the fifth and the sixth inner planes 15*i* and 16*i*, respectively.

Thus, each set of the protrusions and the recesses may be called an engaging portion. In this event, it is readily understood that ten sets of the engaging portions are equipped with the illustrated die while five sets of the engaging portions are equipped with the die illustrated in FIG. 2.

Although description has thus far been restricted to the dice that have five and ten sets of the engaging portions, the number of the engaging portions may be not smaller than four sets. For example, six, eight, and twelve sets of the engaging portions may be equipped with a die.

Figure 9:
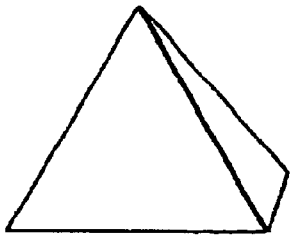
FIG. 9 is a perspective view for describing a die according to yet another embodiment of the present invention.

Making reference to FIG. 9, the external view of a die according to yet another embodiment of the present invention is shown. As can be understood from the figure, the die according to this embodiment has a regular tetrahedron shape configured of equilateral triangle planes.

Figure 10:
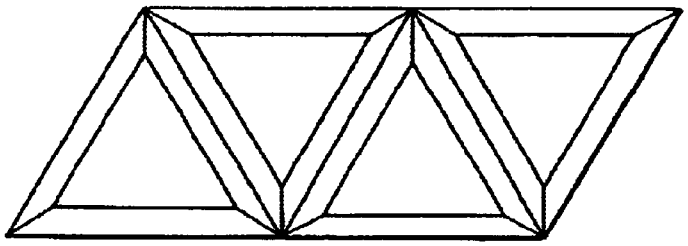
FIG. 10 is a diagram illustrating an opened example of the die shown in FIG. 9.

Making reference to FIG. 10, the inner surface in a case wherein the regular tetrahedron die shown in FIG. 9 is opened onto a two-dimensional plane is shown. Each plane of the regular tetrahedron die is formed of a center area and a boundary area, and the boundary area is provided with an inclined portion having an angle necessary for forming the regular tetrahedron (here, 30 degrees). In the example shown in FIG. 10, the die is opened such that the two-dimensional form forms a parallelogram. Note that for the engaging mechanism necessary for assembling the die opened such as shown in FIG. 10 into a regular tetrahedron die, a mechanism the same as that shown in FIGS. 2A through 2C or FIG. 5 can be used.

Figure 11:
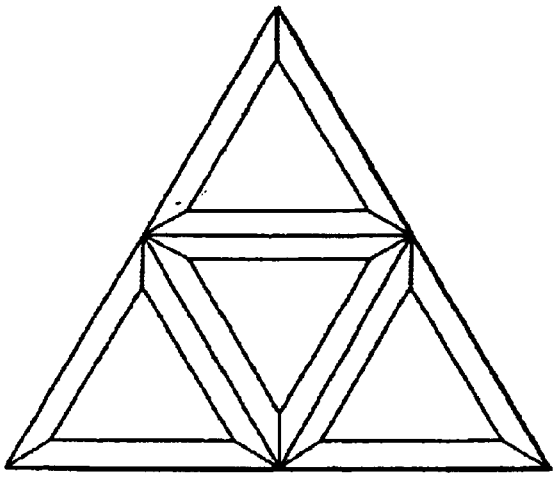
FIG. 11 is a diagram illustrating another opened example of the die shown in FIG. 9.

Making reference to FIG. 11, a case wherein the regular tetrahedron die shown in FIG. 11 is opened onto another two-dimensional shape different from the shape shown in FIG. 10, is shown. In this case as well, a regular tetrahedron die can be assembled in the same manner as with FIG. 10.

Thus, according to the present invention, a die, having a three-dimensional form which can be selectively opened two-dimensionally, can be obtained. Using such dice is advantageous in bringing greater variation to board games using dice, thus increasing user interest in board games.

What is claimed is:

1. A die which is structured by a polyhedron having a multiple planes of a similar shape and which is selectively opened into a continuous polygon area on a plane and closed into an assembled state, wherein, in the assembled state of said polyhedron, said die has outer planes (11*o* through 16*o*) positioned on the outer side and inner planes (11*i* through 16*i*) positioned on the inner side, and has inclined boundary areas (Rb) having a predetermined inclination angle at boundaries of said polygonal area of said inner side, while predetermined inclined boundary areas (Rb) of said opened polygonal area have engaging portions (21*a*, 21*b*, 24*a*, 24*b*, 25*a*, 25*b*, 26*a*, 26*b*) of a size not exceeding each boundary area (Rb);

the die comprising:

bridge portions (Br) which are intermediate between the remaining inclined boundary areas (Rb) except the predetermined inclined boundary areas (Rb); the bridge portions (Br) linking two adjacent ones of the planes to each other to provide a linear extended groove which is left on the outer plane sides of the two adjacent planes and which is placed on an outside of the remaining inclined boundary areas (Rb).

2. A die according to claim 1, wherein said polyhedron is a regular polyhedron.

3. A die according to claim 2, wherein said regular polyhedron is a cube.

4. A die according to claim 2, wherein said regular polyhedron is a regular tetrahedron.

5. A die according to claim 3, wherein said engaging portions are formed on four of the six planes (11 through 16) of said cube.

6. A die according to claim 5, wherein each of said engaging portions (21*a*, 21*b*, 24*a*, 24*b*, 25*a*, 25*b*, 26*a*, 26*b*) comprise one of a recess (21*a*, 21*b*, 25*b*, 26*a*) provided to one boundary area (Rb) and a protrusion (24*a*, 24*b*, 25*a*, 26*b*) provided to another area (Rb) which engages said one boundary area (Rb).

7. A die according to claim 3, wherein said inclination angle is 45 degrees.

8. A die according to claim 1, wherein said polygonal area opened on a two-dimensional plane is linked by bridge portions (Br) thinner than said boundary areas (Rb).

9. A die which has a hexahedron having six planes (11 through 16) and which is selectively closed three-dimensionally and opened two-dimensionally into a continuous polygonal area on a plane, wherein one predetermined plane among the six planes is provided with an opening mechanism (41, 42, 43) to selectively close and open the die in a single touch;

the opening mechanism having a first wall (41) and a second wall (42) both of which form the one predetermined plane (14), a button (43) protruded from the first wall to the second wall (42), and recesses (44*a*, 44*b*) around the first wall (41), and protrusions (45*a*, 45*b*, 45*c*) placed on the adjacent planes (11, 15, 16), such that the recesses and the protrusions are disengaged when the button (43) is pressed.

* * * * *